United States Patent [19]

Villarreal

[11] Patent Number: 4,957,269

[45] Date of Patent: Sep. 18, 1990

[54] RECOVERABLE SELF-SUPPORTABLE CRIBWORK FOR SLABS ON PREFABRICATED BEAMS

[76] Inventor: Jose J. N. Villarreal, Moctezuma #82-E Col. El Carmen, Coypacan, D.F. c.p. 04100, Mexico

[21] Appl. No.: 254,235

[22] Filed: Oct. 6, 1988

[30] Foreign Application Priority Data

Oct. 13, 1987 [MX] Mexico ..... 138381

[51] Int. Cl.[5] ..... E04G 11/42

[52] U.S. Cl. ..... 249/24; 249/29; 249/31; 249/176

[58] Field of Search ..... 249/19, 23, 24, 28, 249/29, 31, 32, 176, 177, 182, 211, 212; 52/326, 329, 330, 338, 339, 640, 87, 127.1, 127.2

[56] References Cited

U.S. PATENT DOCUMENTS

| | | | |
|---|---|---|---|
| 808,951 | 1/1906 | Schuller | 249/23 |
| 938,718 | 11/1909 | Smith | 249/24 X |
| 980,389 | 1/1911 | Zucco | 249/31 |
| 1,652,056 | 12/1927 | Selway | 249/24 |
| 1,914,033 | 6/1933 | Miller | 249/24 |
| 1,928,748 | 10/1933 | Young | 52/326 X |
| 2,180,964 | 11/1939 | Rogow | 249/31 |
| 2,508,635 | 5/1950 | Badt | 249/23 |
| 2,775,019 | 12/1956 | Bemis | 249/31 X |
| 3,035,322 | 5/1962 | Ibeck | 249/212 |
| 3,195,209 | 7/1965 | Klausner | 249/23 |

FOREIGN PATENT DOCUMENTS

| | | | |
|---|---|---|---|
| 1055214 | 7/1959 | Fed. Rep. of Germany | 52/329 |
| 514134 | 3/1921 | France | 249/32 |
| 1488413 | 6/1967 | France | 52/339 |
| 267461 | 9/1929 | Italy | 52/326 |
| 514988 | 2/1955 | Italy | 249/19 |
| 343114 | 1/1960 | Switzerland | 249/33 |
| 358224 | 2/1961 | Switzerland | 249/31 |

*Primary Examiner*—David A. Scherbel
*Assistant Examiner*—Jerrold D. Johnson
*Attorney, Agent, or Firm*—Lowe, Price, LeBlanc, Becker & Shur

[57] ABSTRACT

Apparatus is provided for arch centering for slabs formed on prefabricated beams of reinforced or prestretched concrete, steel, wood, or the like, which includes elements of steel plate or another material having similar properties, constructed in a flat or arched form and with the dimensions that are required, which has four or more steel staples for its temporary support during its use, and two devices, one of which allows the staples to be slightly deformed in an elastic manner for their extraction and another for their leveling and coupling among themselves.

5 Claims, 4 Drawing Sheets

Figure 1A
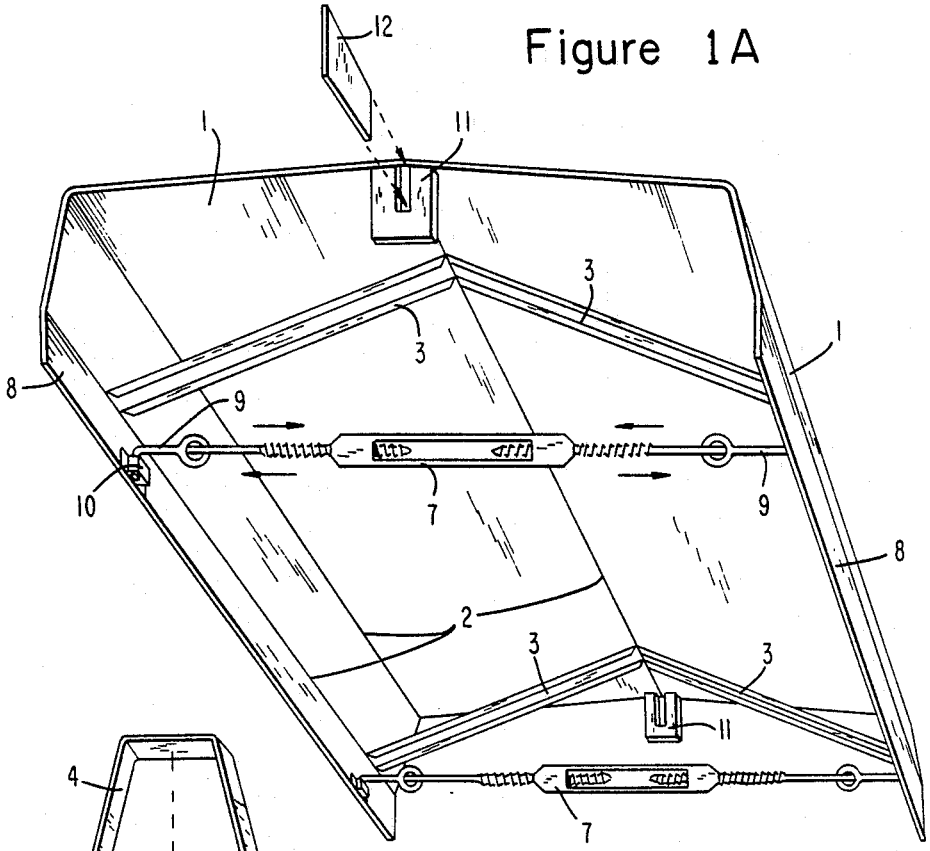
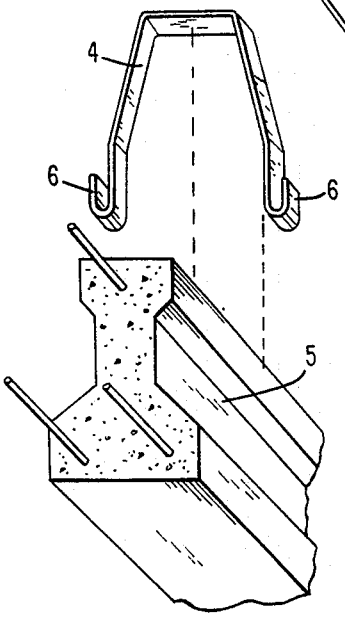
Figure 1C
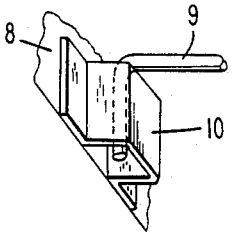
Figure 1B

RECOVERABLE SELF-SUPPORTABLE CRIBWORK FOR SLABS ON PREFABRICATED BEAMS

FIELD OF THE INVENTION

This invention relates to a mold assembly for producing arch centering on the basis of steel plate or any other material with similar properties, and, more particularly to one constructed in a flat or arched form with slight bends and rigidizing elements and with dimensions according to the beams and raisings separations as determined by the structural design of the slab, and of an appropriate length to facilitate manual handling without the need for a crane or some type of mechanical equipment.

BACKGROUND OF THE INVENTION

There currently exist various systems for the construction of concrete slabs for the floor structure and flat roof in the building of real estate for housing, offices, commercial establishments, industries, etc. Such structures include those that are poured in place, those that are prefabricated, and combinations of both of these. In the latter of these are found slab systems formed on the basis of concrete plates, others with "T" or double "T" beam or box beam forms, and still others on the basis of beams or joists and arches between steel floor beams.

In the field of the slab systems comprising joists and arches between steel floor beams there are several types, both in form and in manufacturing process, but which in summary can be described as the combination of the following elements:

(1) a strong element for resisting stress, designated beam, joist, half-joist or stringer;

(2) a filler element which has the function of acting as drowned or lost arch centering and which occupies a space which does not function structurally called the arch between steel floor beams; and (3) a third element of simple or reinforced concrete which is poured in place on the upper bed of the former two, forming the system's compression zone for integration into a single structural body called the slab.

The significance of my invention is that in a very simple manner the use of the arch between steel floor beams is eliminated, providing an economical and easy solution for the construction of floor structures and roofs on the basis of beams or joists and compression slabs, having great advantages such as:

(1) a considerable cost savings upon eliminating an element which does not work structurally and which is not recoverable unlike my invention which substitutes this element and which is recoverable after the setting of the compression slabs; and (2) Savings in dead weight in the case of cement or ceramic arches between steel floor beams. In the case of polystyrene arches between steel floor beams the weight is negligible, but the savings is of an economic type.

In other cases the purpose of my invention is to obtain a floor structure or flat roof on the basis of stringers and compression slabs, the final configuration of which is that which would be obtained with known systems such as beams or prefabricated "T" or double "T" slabs, which in certain construction work can present transportation or placement difficulties due to their great weight and dimensions. By contrast, with my invention the procedure is simplified, requiring mounting of only the rectangular section prefabricated beams and employing my self-supportable arch centering for the pouring of the slab.

In this case and in the aforementioned one, the additional advantages are:

(a) Cost savings, because other materials are not required for generating the finish on the lower bed of the floor structure or flat roof;

(b) Speed in its placement, since it is self-supportable, not requiring a false construction;

(c) Speed in stripping forms, since its recovery is done by means of its elastic deformation device; and (d) Greater number of uses, since the stripping can be effected in some cases after the initial setting of the compression concrete (approximately four hours).

SUMMARY OF THE DISCLOSURE

Accordingly, it is the principal object of this invention to provide a recoverably self-supporting mold assembly, suitable for pouring concrete slabs on spaced apart parallel beams, elements of the mold assembly being securely supportable for use and readily releasable upon the deformation of mold panels support means following setting of concrete poured thereon.

This principal objective and other related objectives are met by providing a recoverable self-supporting mold assembly, suitable for pouring of concrete slabs thereon for the same to be supported by spaced apart parallel beams, the assembly comprising a mold panel that comprises sheet material formed to have a generally planar central panel portion having side wall portions depending therefrom generally normal thereto with the side wall portions being spaced and generally parallel to be received between adjacent parallel support beams, mold panel support means disposed on and supported by the beams for receiving and supporting the wall portions of the mold panel, the mold panel having spaced substantially parallel stiffening bends therein, and removable tensioning means extending between the wall portions adjusting the spacing between adjacent wall portions, wherein the mold panel support means comprise a plurality of elongate metal straps having a generally inverted U-shape shaped and sized to fit closely over the beams with arms of the U-shape depending downwards on opposite sides of a corresponding beam, the arms having at their extremities initially reverse bent portions forming generally U-shaped receptacles for supporting edges of the wall portions, the reverse bent portions being disposed to be accessible to be forcibly bent downward following setting of concrete formed over the mold panel for thereby permitting removal of the mold panels following application of the tensioning means to reduce the spacing between the adjacent wall portions of the mold panels.

BRIEF DESCRIPTION OF THE DRAWINGS

The characteristic details of this invention are made clear in the following description of the system when taken with the following drawings, wherein the same reference numbers serve to indicate the in the figures shown:

FIGS. 1A–1C illustrate, in upwardly directed perspective views, details of the mold assembly structure and particular elements thereof according to a preferred embodiment of this invention.

DESCRIPTION OF THE PREFERRED EMBODIMENTS

Figure 2:
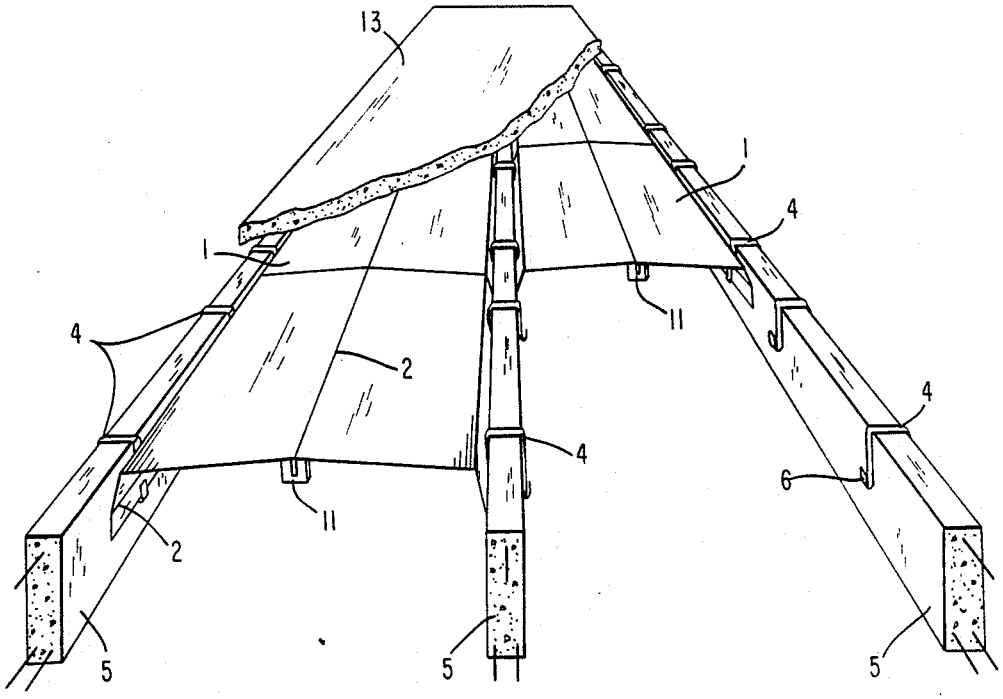
FIG. 2 is a fragmented perspective view of the arch centering in place, looking down from above, where the arch centering, the support staples, the prefabricated beams and the concrete slab noted.

A very important characteristic of this arch centering mold assembly is its being self-supportable because it has as a substantial novelty a metallic element or of any other resistent material, in the form of a staple which is placed from the upper part of the beam, set in such a way that its ends hang downward and at both sides of the beam, with the particularity that both ends have a 180° outward bend on which the arch centering is supported, each arch centering requiring at least four of these supports. The arch centering will remain supported on these staples until the concrete of the slab has reached the minimum resistance necessary from stripping forms, at which time the staple bends fold downwards 180° to allow the extraction of the arch centering.

The staples will have the form and dimension relating to the geometry of the section of the prefabricated beam and will be drowned in the concrete of the slab, with the exception of their end hooks, which can be cut once the arch centering is withdrawn, or they can be left to be used as support rods for any piping or for supporting an artificial ceiling if required.

A characteristic of this arch centering is its recovery by means of a device which allows it to be slightly deformed in order to ease its extraction. This device consists of a common contrary cord turnbuckle with a hook on each of its ends, which is inserted into two ears of the arch centering located on the opposite walls of those in contact with the prefabricated beam, on the inner side and on the lower side of said walls. Each arch centering requires a minimum of two stripping turnbuckles with their respective ears. The stripping ears are fixed to the arch centering walls, while the stripping turnbuckles are removable, in such a manner that a single set of turnbuckles can be used by each workman doing the stripping, it is not being limiting that in case these turnbuckles are necessary, they can be fixed to the arch centering.

In both cases, fixed or removable, a tri-articulated bar system of known type can be used as an alternative, which acts by closing the mentioned walls upon operating it downward with one's hand.

The arch centering is manufactured with strategic bends for rigidizing it and in addition has stiffening elements, due to which upon applying the stripping turnbuckle, a slight deformation will be achieved in the opposite walls which are in contact with the prefabricated beam, that is, that upon actuating said turnbuckle, the mentioned walls tend to come together. This action, together with the folding of the hooks of the support staples, allows the removal of the arch centering, overcoming with a pull the normal adherence existing with newly molded concrete; this pull is effected manually using the same stripping turnbuckles as pullers. Upon re-loosening the turnbuckles, the arch centering once again acquires its original form.

The arch centerings contain on their opposite ends which are not in contact with the prefabricated beam, two leveling and coupling ears, fixed on the upper face of the arch centering and on the inner part. These ears have a vertical groove, in such a manner that upon placing two consecutive back-to-back arch centerings, the grooves coincide and a flat steel wedge is inserted in them in order that upon pressing it, it becomes possible to even up the upper levels of the arch centerings, in this way eliminating the producing of steps or small differences of elevation of the slab concrete. It is a condition that both ears coincide with the arch centering's symmetry axis.

It is convenient to clarify that in some cases it will be required to build adjusting arch centering for the ends of the beams in the zone where these are supported; it will also be necessary to add to them a perpendicular plate cap to the arch centerings and on the exact end, in order to avoid that the slab concrete spills over through the hollow which is produced in the mentioned beam support.

FIG. 1 shows the arch centering 1, looking down from above, indicating its rigidizing bends 2 and its stiffening elements 3. This arch centering 1 is supported on elements called support staples 4 which have been previously placed from the upper part of the prefabricated beam 5. Each staple 4 has two 180° bends at its ends, in the form of hooks 6, where the arch centering 1 is inserted from above and by which it is in fact supported. Also visible in this figure devices called stripping turnbuckles 7, which can be operated to slightly deform the walls 8 of the arch centering 1, tending to close. These turnbuckles 7 each have a hook 9 on their respective ends which are inserted in the corresponding stripping ears 10. When the turnbuckles 7 are loosened, the walls 8 of the arch centering 1 recover their original position, since the stiffeners act for this effect. For the leveling and coupling of the arch centerings 1, the grooved ears 11 are used, over which the leveling wedge 12 is passed, which will produce the earlier mentioned coupling effect.

FIG. 2 provides an overall view of the arch centering 1, placed on the support staples 4 and these in turn placed on the prefabricated beams 5. A zone of concrete slab 13 can be noted that is molded over the arch centering 1 and the beams 5. Also seen are the rigidizing bends 2, the leveling and coupling ears, and in the case of the staples 4 the support bends 6 of the arch centering can be noted.

Figure 3:
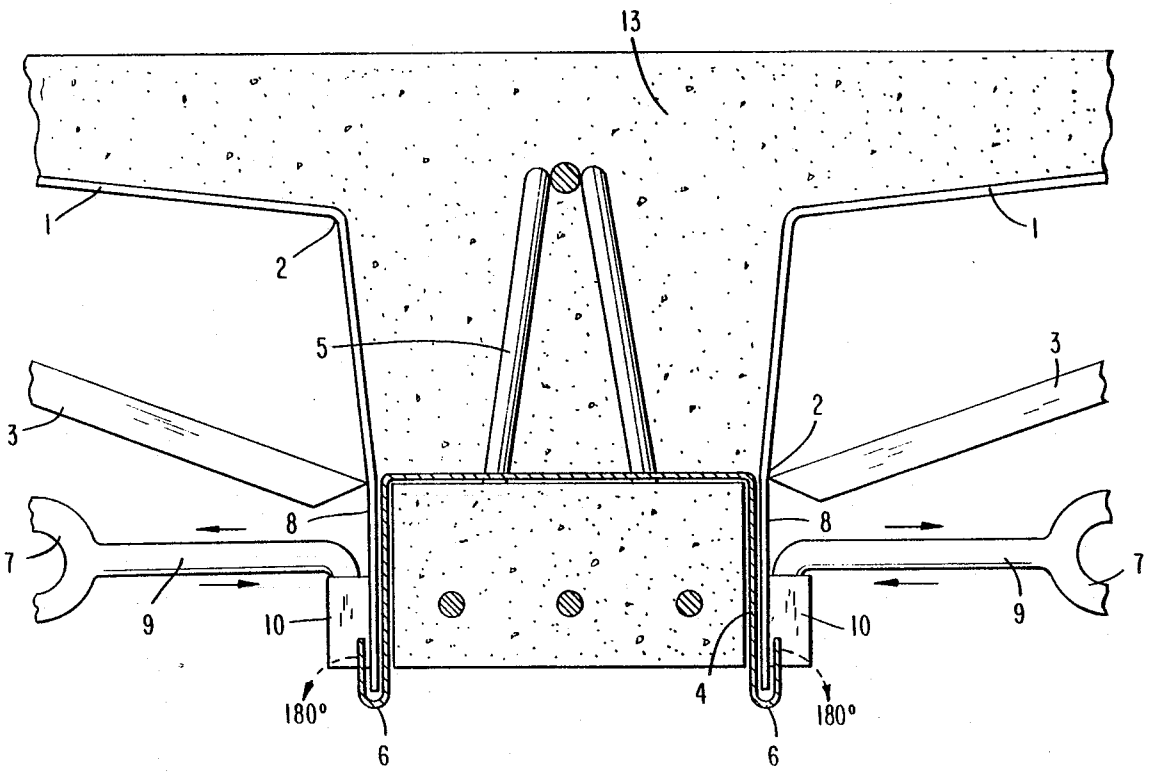
FIG. 3 is a cross-section view of a transverse section of the prefabricated beam, the arch centering and the concrete slab, in schematic form.

FIG. 3 is a schematic view at a section of the contact zone of the arch centerings 1 showing support staple 4, placed over a prefabricated beam 5 of the joist or open-center arch between steel floor beams type and the concrete slab 13. In this figure, part of the arch centering 1 is indicated, with its rigidizing bends 2, the stiffeners 3, regarding which it can be seen that its end is fixed to the wall 8 of the arch centering 1 exactly at the bend 2, since if it had been fixed farther down the deformation of the arch centering 1 would not be allowed, produced by the action of the stripping turnbuckle 7.

The hook 6 of the support staple 4, best seen in FIG. 3, is eventually folded 180° downward to allow the extraction of the arch centering 1. Hook 9 of the turnbuckle 7 can also be noted as inserted in the ear (10).

Figure 4:
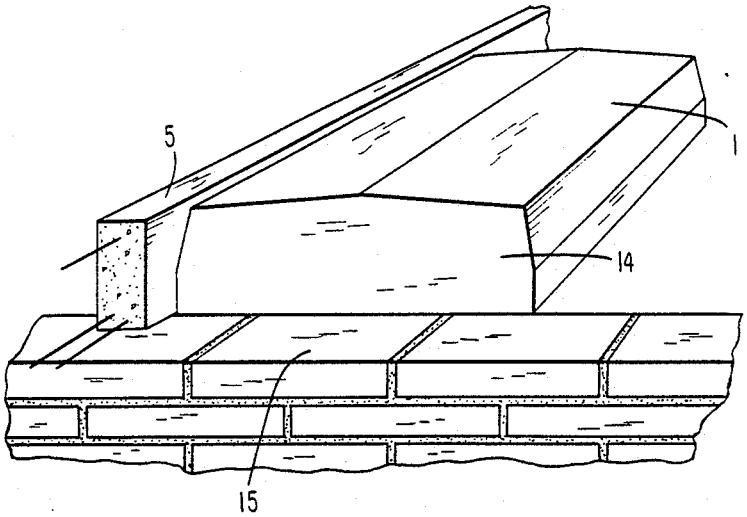
FIG. 4 is a perspective view of the adjusting arch centering, with its plate cap seen from above.

FIG. 4 illustrates how the plate cap is equipped to the adjusting arch centering 1, which will avoid that the concrete of the slab spills over during the pouring of the same of the support end 15 of the prefabricated beam 5.

Figure 5:
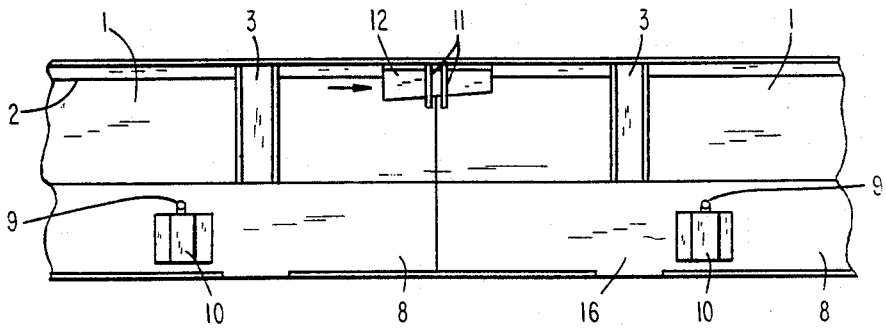
FIG. 5 is a longitudinal view of the arch centering illustrating details between two consecutive arch centering elements.

In the schematic view of FIG. 5, the connecting of the ends of two adjacent sections of arch centering 1 by means of the leveling wedge 12 is shown. The wedge 12 is passed within apertures provided therefor in the leveling ears 11. A part of the walls 8 of the arch centering is also shown, to which the stripping ears 10 are fixed, where the hooks 9 of the stripping turnbuckles are inserted, as are the stiffening elements 3 and the support zone 16 which is inserted into the support staples that are mentioned in previous descriptions.

In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

I claim:

1. A recoverable self-supporting mold assembly for pouring concrete slabs on spaced parallel beams, comprising:

a mold panel comprising sheet material formed to have a generally planar central panel portion having side wall portions depending therefrom generally normal thereto, said side wall portions being spaced and generally parallel to be received between adjacent parallel beams;

mold panel support means disposed on and supported by said beams for receiving and supporting said wall portions;

said mold panel having spaced substantially parallel stiffening bends therein; and removably tensioning means extending between said wall portions for adjusting the spacing between adjacent wall portions, wherein said mold panel support means comprise a plurality of elongate metal straps having a generally inverted U-shape shaped and sized to fit closely over said beams with arms of said U-shape depending downwards on opposite side of a corresponding beam, said arms having at their extremities initially reverse-bent portions forming generally U-shaped receptables for supporting edges of said wall portions, said reverse-bent portions being disposed to be accessible to be forcibly bent downwards following setting of concrete formed over said mold panel for thereby permitting removal of said mold panels following application of said tensioning means to reduce said spacing between said adjacent wall portions of said mold panels.

2. A mold assembly according to claim 1, further comprising:

a stiffening member extending between a central region of said central portion and an intermediate region of said wall portions.

3. A mold assembly according to claim 1, wherein:

said mold panel includes at opposite ends of said central panel portions means for connecting multiple mold panels arranged in abutting longitudinal relationship.

4. A mold assembly according to claim 3, wherein:

said connecting means comprises slotted ears attached to the under side of said central panel portions at opposite ends thereof, the slots in said ears being adapted to receive wedges interconnecting adjacent ears in adjacent mold panels.

5. A mold assembly according to claim 1 wherein:

said tensioning means comprises turnbuckle means removably connected to said spaced wall portions for providing and adjusting a tension force between said wall portions, said tension force being created by tightening said turnbuckle to controllably stress said stiffening bends.

* * * * *